United States Patent [19]

Lathrop et al.

[11] Patent Number: 5,073,057

[45] **Date of Patent: * Dec. 17, 1991**

[54] DISPENSING CONTAINER HAVING CAPILLARY PRESSURE COMPENSATING VALVE

[75] Inventors: Stephen C. Lathrop, Butler; Keith Woodruff, Mountainside; Edward Morris, Paramus, all of N.J.

[73] Assignee: The Procter & Gamble Company, Cincinnati, Ohio

[ * ] Notice: The portion of the term of this patent subsequent to Nov. 6, 2001 has been disclaimed.

[21] Appl. No.: 590,449

[22] Filed: Sep. 21, 1990

Related U.S. Application Data

[63] Continuation of Ser. No. 418,952, Oct. 6, 1989, abandoned, which is a continuation-in-part of Ser. No. 208,822, Jun. 17, 1988, abandoned, which is a continuation-in-part of Ser. No. 880,905, Jun. 27, 1986, abandoned, which is a continuation of Ser. No. 529,068, Sep. 2, 1983, abandoned.

[51] Int. Cl.[5] ..... A45D 34/00

[52] U.S. Cl. ..... 401/206; 401/148; 401/202; 401/261; 401/266

[58] Field of Search ..... 401/148, 186, 196, 202, 401/206, 207, 262, 261, 266

[56] References Cited

U.S. PATENT DOCUMENTS

| | | | |
|---|---|---|---|
| 1,621,567 | 3/1927 | Van Sant | 401/266 |
| 1,949,162 | 2/1934 | Kallenbach | 401/266 |
| 2,749,566 | 6/1956 | Thomas | 15/132.7 |
| 2,921,324 | 1/1960 | Gibbons | 401/266 X |
| 2,923,957 | 2/1960 | Gentile | 15/132.7 |
| 2,996,750 | 8/1961 | Cholet | 401/206 |
| 2,998,616 | 9/1961 | Gentile | 15/572 |
| 3,610,766 | 10/1971 | Herrnring | 401/261 X |
| 4,043,681 | 8/1977 | Funahashi | 401/206 X |
| 4,050,826 | 2/1976 | Berghahn | 401/196 |
| 4,111,567 | 9/1978 | Berghahn et al. | 401/202 |
| 4,480,940 | 11/1984 | Woodruff | 401/206 |

*Primary Examiner*—Steven A. Bratlie

*Attorney, Agent, or Firm*—R. C. Witte; T. H. O'Flaherty; J. V. Gorman

[57] ABSTRACT

Device for applying liquid materials to the skin, said device having a liquid container, a poromeric plastic applicator head, and a diaphragm spring holding the applicator in said device. The diaphragm spring provides a liquid tight seal between the poromeric applicator head and the liquid container and also allows movement of the poromeric applicator head in a vertical direction to create a pressure within the liquid container and provide force to aid in moving the liquid through the poromeric applicator head to its outer surface. The poromeric applicator head is also provided with a capillary pressure compensating valve to maintain substantially equal pressure within and without the dispensing container.

7 Claims, 1 Drawing Sheet

DISPENSING CONTAINER HAVING CAPILLARY PRESSURE COMPENSATING VALVE

This application is a continuation of Ser. No. 07/418,952, filed Oct. 6, 1989, now abandoned; which was a continuation of Ser. No. 07/208,822, filed June 17, 1988, now abandoned; which was a continuation of Ser. No. 06/880,960, filed June 27, 1986, now abandoned; which was a continuation of Ser. No. 06/529,068, filed Sept. 2, 1983, now abandoned.

The present invention relates to a liquid applicator for dispensing toiletries to the skin, and particularly for the application of antiperspirants and deodorants to the human axilla.

Liquid applicators in general are well-known in the prior art, particularly the roll-on type commonly for antiperspirants and deodorants. These are disclosed, for example, in U.S. Pat. Nos. 2,749,566; 2,923,957; and 2,998,616. Because of problems with roll-on type applicators, Berghahn et al., U.S. Pat. Nos. 4,050,826 and 4,111,567, devised a liquid applicator comprising a container fitted with a head having a fixed, shaped form made of a non-flexible, non-deformable, sintered porous synthetic plastic resin having a controlled porosity and having omnidirectional, interconnecting pores. The liquid overflow problems associated with conventional roll-ons is also present with this type of head and is solved by the provisions of a liquid collecting channel adjacent the shaped applicator, permitting the excess liquid to drain back via the channel into an opening through the head into the liquid reservoir. This avoids an accumulation of liquid on the surface of the applicator and resulting crystallization of product being delivered.

In a real sense, the porous plastic applicator of Berghahn et al. resembles the conventional roll-on applicator except that it is stationary and has a drain channel. The liquid product being delivered must be brought into contact with the applicator head in order for the liquid to be delivered to the surface by capillary action. This requires inverting the container, as is true of the roll-on type of head, since there will always be dead space between the liquid in the reservoir and the applicator head. Thus, no way is provided for the liquid in the reservoir always to be in contact with the applicator head.

In copending commonly assigned application Ser. No. 86,225, filed Oct. 18, 1979, is disclosed a delivery system for liquid toiletry products whereby a liquid product is absorbed onto an absorbent material which is in intimate contact with a non-flexible, non-deformable, sintered, porous synthetic resin applicator head having a controlled porosity and omni-directional interconnecting pores, and whereby the absorbed liquid product is continuously delivered to the porous applicator head by capillary flow on demand.

The device has the advantage of eliminating dead air space and the need to invert the container, since the liquid is always in contact with the applicator head and available on demand at the surface of the applicator head.

Although the dispensing device of the copending application Ser. No. 86,225, resulted in a greatly improved control of flow and distribution of product, it was found the flow of product through the porous applicator head by capillary action was still not as great as desirable. This was due to the fact that product is removed from the surface of the applicator head by the user faster than the product it provided from and through the head by capillary flow. It was further found that as liquid product was used up, the capillary flow to the outer surface of the porous dispenser head decreased to an unsatisfactory level or even, for all practical purposes, ceased. This was determined to be caused by a build up of vacuum pressure within the container. Since the porous head was filled with liquid and the liquid has a capillary attractive force to the head, the atmospheric pressure outside the container was not sufficient to force the liquid through the pores. In commonly assigned copending application Ser. No. 97,383, filed, May 23, 1983, it was proposed to solve this problem by providing a vent hole punched through the porous dispenser head at or near its center. Although this does prevent a vacuum from building within the container, this is by virtue of the fact that it is a true vent hole and is always open to the atmosphere. This is a problem in that when the package is inverted, liquid flows freely out of the package and through the vent hole. In addition, it was further found that when a vent hole is formed by punching through the porous head, the sides of the holes are compressed outwardly but later tend to relax inwardly toward their original position. This is due to elastic memory of the porous plastic materials. This phenomena reduces the size of the hole rendering it virtually ineffective as a vent hole.

In copending commonly assigned application Ser. No. 38,327, filed Apr. 14, 1982, it was proposed to solve the liquid flow problem through the porous head by providing means to generate internal pressure to supplement capillary action when the porous plastic dispensing head of the container is pressed against the skin. Pressure is created by a reduction of the container internal volume as the porous plastic head, mounted in a spring means, travels back into the container. When the porous head is no longer pressed against the skin, it returns to normal position. Although this dispensing container does increase the flow of liquid product to the outer surface of the dispenser head initially, it has been found that it is cyclical, i.e. the vacuum pressure within the container must build up to a level, regardless of the number of times the dispenser is used before air is drawn through the pores of the dome and pressure differential is reduced. Moreover, the amount of liquid reaching the outer surface of the porous dispenser head was still only enough to wet the outer surface and did not provide satisfactory pay out for applying to a surface. The stroke distance of the spring means was insufficient to fully compensate for the vacuum. Thus, although a number of solutions have been proposed to provide a liquid dispenser with a porous plastic dispensing head, all of which were operable, none has been capable of delivering consistent product/package functionality over the life of the package.

It has now been found that the disadvantages of the previously proposed containers may be overcome, and a satisfactory flow of fluid sustained by the user of the present invention. The present invention basically comprises means to generate pressure within the container and wherein the porous plastic dispensing head has a specially designed and constructed capillary pressure compensating valve.

In the present invention, the applicator head may be of any suitable configuration, but a convex outer surface has been found to be particularly suitable for contact with various parts of the human body. Thus, applicator head may have a hemispherical outer surface.

The materials which are used to make the shaped applicator head are non-flexible, non-deformable, sintered, porous synthetic resins having a controlled porosity and having omni-directional interconnecting pores, formed of aggregates of united polymer particles. The degree of porosity of the porous materials can be controlled in their manufacture, thus insuring a wide range of porosity to suit a wide range of liquid products of varying viscosities. Sintered, porous applicator heads may be fabricated of high-density polyethylene, low-density polyethylene, ultra-high molecular weight polyethylene, polypropylene, polyvinylidene fluoride, and the like. Products are available commercially under the trade designations "Porex" porous plastics and "Porous Poly." The pore size of the applicator may vary widely, depending on the liquid to be delivered. Low-viscosity liquids, such as perfumes, may best be delivered via a small-pore plastic applicator, e.g., one micron or less. In general, the pore size may vary between about one to 200 microns, and for most purposes, generally about 10–50 microns are preferred.

The capillary pressure compensating valve is preferably formed at or near the center area of the dispenser head. The capillary valve must be of such a diameter that it holds liquid by capillary force even when the container is upside down. It further should maintain its integrity and size. In addition, it should be constructed such that it is free from debris and remains so. One method of meeting these requirements is by drilling a small precision capillary hole through the head with a counter-sink area preventing accumulation of debris and clogging of the hole opening which can occur due to the small diameter of the hole. This forms a capillary pressure compensating valve. The diameter of the capillary valve should range from about 0.005 to 0.030, preferably 0.010 to 0.025 inches. The size of the capillary pressure compensating valve is in relationship to the surface tension of the product and the desired pressure differential required to maintain the valve functionality.

The porous applicator head is attached to an annular plastic diaphragm spring which, in turn fits into the top opening of the container which forms a reservoir for the liquid material to be dispensed. The container can be filled solely with the liquid product. As an alternative, the reservoir may contain an absorbent material, onto which the liquid to be delivered is absorbed, and this absorbent material is in direct and intimate contact with the porous applicator head. This aspect of the invention insures continuous contact of the liquid with the applicator head and facilitates delivery of the liquid on demand by capillary flow.

The container may obviously be of any suitable material, such as metal, glass, or plastic.

The delivery system of the invention may be used to deliver any topical liquid product to the skin. These may include, for example, after-shave lotions, pre-shave lotions, skin lubricants or emollients, suntan lotions, fragrances (perfumes, colognes, etc.), topical therapeutics (analgesics, acne formulations, antiseptics, etc.), lip and face rouge and the like. The delivery system is particularly useful in applying antiperspirants and deodorants and avoids the problems associated with roll-on applicators. Thus, the invention provides a means of applying a low viscosity, fast drying, non-sticky solution of aluminum chlorhydrate, avoiding the undesirable features of roll-ons, pump sprays, and sticks.

Since the porous plastic materials are hydrophobic and do not "wet" with water, it may be necessary to add alcohol to an antiperspirant formula to transfer the product from the container to the applicator head. Crystallization of the solid components of the solution, such as aluminum chlorhydrate, may be avoided by the addition of certain esters, such as isopropyl myristate or isopropyl palmitate.

The invention may be better understood by reference to the drawings in which.

Figure 1:
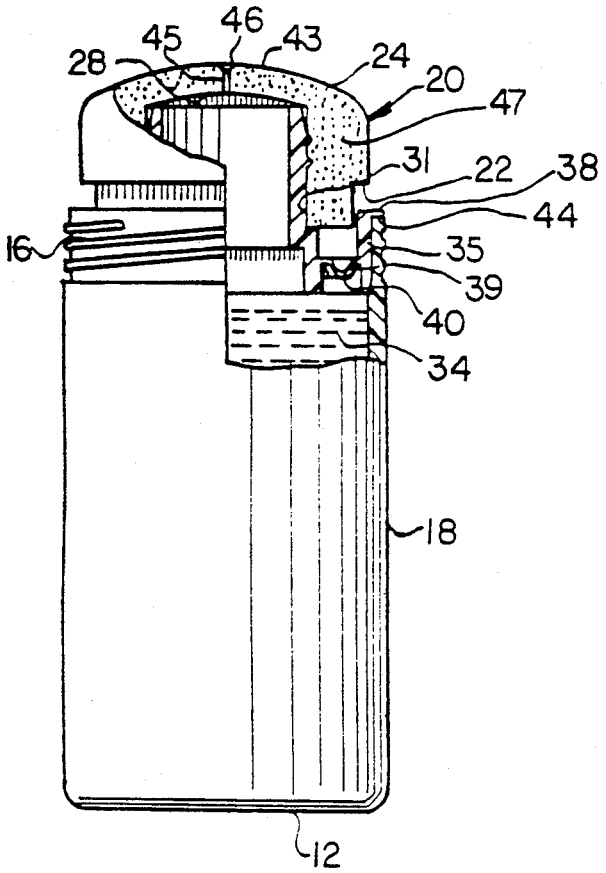
FIG. 1 is an elevational view with parts broken away to show a cross-section of the applicator head, diaphragm spring and reservoir.
Figure 2:
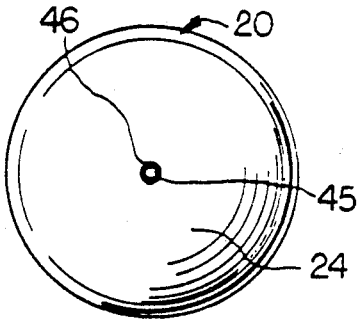
FIGS. 2 and 3 are respectively a top plan view and a bottom plan view of the applicator head construction.
Figure 3:
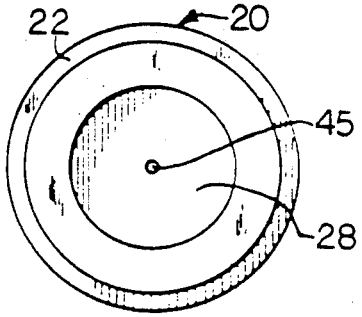
Figure 4:
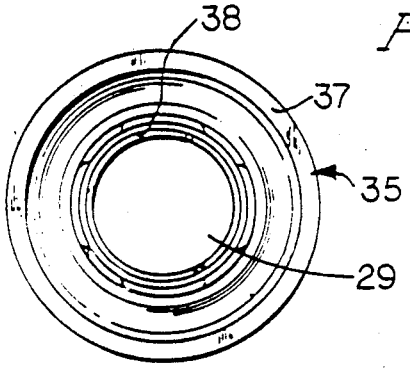
FIGS. 4, 5 and 6 are, respectively, a top plan view, an elevational view in cross-section, and a bottom plan view of the annular plastic spring.
Figure 5:
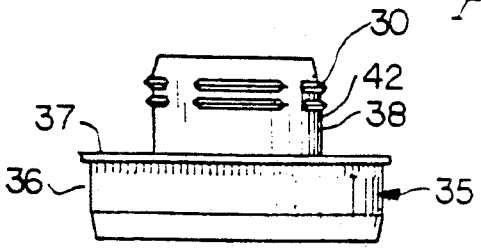
Figure 6:
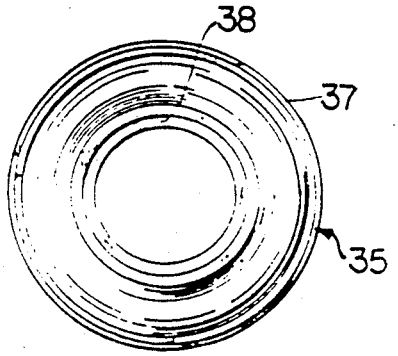

Referring to the FIGS. 1 and 2, the liquid delivery system comprises an outer case 10 having a base 12. Case 10 is shown with threads 16 to attach a cap, not shown, which could alternatively be attached by a friction fit. Case 10 contains the liquid product 34 to be dispersed. A porous plastic applicator head 20 is fitted onto an annular elastic spring 35 central opening 41 of spring 35. Spring 35 has two concentric cylindrical segments, cylindrical segment 36 with a flange 37 on the top and an inner cylindrical segment 38. The outer cylindrical segment 36 and inner cylindrical segment 38 are joined by an annular undulate member 39, having an annular undulation 40, as shown, undulation 40 is downward. Applicator head 20 has an inner cylindrical wall 31 which fits over inner cylinder 38 of spring 35 in a fluid tight relationship. Inner cylinder 38 has annular ridges 42 which engage inner wall 31 of applicator head 20 and fasten the head firmly. The upper end of inner cylinder 38 may be tapered inwardly to facilitate insertion into head 20. The upper end 42 of the inner cylinder 38, in addition to fastening head 20 to diaphragm spring 35, also acts as an impervious sleeve to seal the inner wall 31 of applicator head 20 so that liquid product is directed toward the upper surface 43 of head 20. The applicator head-spring assembly is inserted into container 10 and the outer segment 36 of spring 35 forms a fluid tight friction fit with flange 37 resting on the top rim 44 of container 10. Applicator head 20 is cut in at the lower end so that it extends within outer cylindrical segment 36 of spring 35. In this arrangement the head 20 can move into the container 10 when pressure is applied to the head and the undulate surface 39 of spring 35 is deformed. Applicator head 20 may be depressed until the shoulder 22 of head 20 contacts flange 37 of spring 35 which then acts as a stop. Applicator head 20 has a capillary pressure compensation valve 45 having a counter-sink 46 at its upper end. Capillary valve 45 contains liquid, except when a differential pressure forces the liquid out. Afterward the pressure differential within and without the container stabilizes but never goes to zero. In operation, container 10 is first inverted wetting the inner surface 28, and then by capillary action liquid 34 flow the pores of head 20. When the outer surface 24 of head 20 is rubbed against the skin, liquid product 34 is applied to the skin. The pressure on head 20 pushes the head into container 10 increasing the pressure in the container, forcing liquid 34 out through the pores of head 20, thus supplementing the capillary flow and assuring an adequate flow of liquid product 34 to the outer surface of head 20. In the embodiment shown in FIG. 1, applicator head 20 has a somewhat flattened outer surface 24 with the vertical side section 47 being thicker than the upper surface 24. This serves two purposes. First, it will serve to absorb any liquid overflow, thus minimizing any liquid dripping down the sides of head 20 and container 10. Second, the flattened head provides a larger spreading area for spreading the liquid 34 over a surface. Any liquid that runs down the sides will be reabsorbed by the thickened area 47 of head 20. The removal of liquid from applicator head 20 builds up a vacuum pressure in container 10. When pressure on head 20 is released, and head 20 rises, the outside pressure forces the liquid from capillary valve 45, air enters container 10 and the pressure inside and outside container 10 are essentially equalized. This valve action takes place each time head 20 is depressed and released. Thus no vacuum can build up within container 10 to impede the flow of liquid through the pores of head 20.

Thus, by the use of means for generating internal pressure within container 10, viz. diaphragm spring 35, sufficient liquid flow is obtained to outer surface 24 of head 20. Further, the use of capillary pressure compensating valve 45 maintains a constant low level pressure differential. As a result, the liquid flow remains constant throughout the use up period. Counter-sink 46 serves to prevent clogging of capillary valve 45 due to dried salts or debris.

It should be understood capillary valve 45 is a true valve, and not a vent hole. Capillary valve 45 opens and closes in response to differential pressure inside and outside the container. As described above, valve 45 prevents vacuum build up within container 10. After the liquid has been forced from valve 45 to open the valve and pressure compensation occurs, liquid fills the valve either a) through the pores of head 20 via capillary flow or b) via capillary flow from the inner or outer surface of the dome into the valve opening. This sequence occurs each time the applicator head 20 is depressed and released. A conventional vent hole open to the atmosphere is not desirable since it leaks liquid when the package is inverted and also squirting of excess liquid when the applicator head is depressed.

Capillary valve 20 also serves to relieve excess pressure build up within container 10. This can occur when the container should be subjected to higher temperature, higher altitude, or changing barometric pressure. In this case, the increased pressure within container 10 forces liquid from valve 45 and air escapes from inside container 10 to essentially equalize inner and outer pressure. If this did not take place, the liquid in the pores of head 20 would be forced out and run down the sides of the container.

To facilitate wetting of applicator head 20, case 10 may be filled with an absorbent material not shown filling container 10, and in contact with inner surface 28 of applicator head 20.

It will be obvious that other variations of the applicator head may be made. For example, the inner cylinder 38 may be a separate piece fitting within a separate diaphragm spring. Such variations are shown in copending, commonly assigned application Ser. No. 06/529059, filed Sept 2, 1983, now abandoned.

In the following specific Examples, the applicator head with a capillary pressure compensating valve was made as follows:

A porous plastic applicator head of polyethylene, having average pore size of 16 microns or 0.000016 inches was used. A heated cone-shaped mandrel was utilized to produce a counter-sink area with a smooth melted surface in the upper surface of the applicator head. The porous heads were then cooled to minus 40° C. for about ½ hour, or sufficient time to cool both plastic and occluded air. A 0.018" drill with a countersink was used to drill through the upper surface at the center of the heat-treated area. The drilled thickness was about ⅜ inches. In order not to exceed the viscoelastic point, drilling was done slowly so as not to generate heat. Rotational speed was 150 revolutions per minute and speed of penetration was five seconds per inch. At this rate, there was no melting or torn stringy fibers of plastic within the drilled cavity.

EXAMPLE 1

A container was assembled using the obtained applicator head. The container was filled with the following formulation:

| | % wt. |
|---|---|
| Aluminum sesquichlorohydrate | 25.0 |
| Aluminum tristearate | 2.5 |
| Cyclomethicone | 3.5 |
| Fragrance | 0.5 |
| SD-40B ethanol (190) | q.s. to 100 |

When the applicator head was wetted and depressed, the outer surface had a sufficient liquid film. This continued until all liquid was used up.

EXAMPLE 2

By comparison, an identical package without use of a capillary pressure compensating valve to decrease the internal pressure differential built up a vacuum which was not relieved until a change in barometric pressure or temperature exceeded the capillary attractive force with the porous head. Consequently, the amount of fluid delivered was very low.

EXAMPLE 3

An identical package without use of internal pressure or capillary valve delivered a very low amount of liquid and soon built up a vacuum within the container so that liquid delivery was even further reduced.

EXAMPLE 4

An identical package having internal pressure generating means, but no capillary valve initially delivered a satisfactory amount of liquid, but built up an internal vacuum and liquid delivery became very low.

A variety of other liquid products may be dispensed by means of the invention. Illustrative products are set forth in the following specific Examples.

EXAMPLE 5

| After Shave Lotion | % wt. |
|---|---|
| Alcohol (SDA-40 or 39C) | 60.00 |
| Propylene Glycol | 3.00 |
| Water, deionized | 36.00 |
| Fragrance | 1.00 |

EXAMPLE 6

| After Shave Lotion (low alcohol, antiseptic) | % wt. |
|---|---|
| Alcohol (SDA-40) | 40.000 |
| Hyamine 10X(Rohm & Haas) methyl benzethonium chloride | 0.250 |
| Menthol | 0.005 |
| Ethyl p-aminobenzoate | 0.025 |
| Water, deionized | 59.720 |
| Fragrance | q.s. |

EXAMPLE 7

| Pre-Shave (beard softener and lubricant) | % wt. |
|---|---|
| Alcohol (SDA-40) | 80.00 |
| Di-isopropyl adipate | 5.00 |
| Menthol | 0.05 |
| Propylene glycol | 3.70 |
| Lactic acid (80%) | 0.30 |
| Water, deionized | 9.95 |
| Perfume | 1.00 |

EXAMPLE 8

| Pre-Shave Lotion | % wt. |
|---|---|
| Standamul G (Henkel) (octyl dodecanol) | 10.00 |
| Alcohol (SDA-40) | 90.00 |
| Perfume, Color, Preservatives | q.s. |

EXAMPLE 9

| Cologne (men's or ladies) | % wt. |
|---|---|
| Alcohol SDA-40 | 80-90 |
| Perfume | 4-6 |
| Water, deionized | 4-16 |

What is claimed is:

1. A liquid applicator suitable for use in the application of liquids to a surface, said liquid applicator comprising a container having a container body adapted for storing a quantity of liquid, said container having an opening at the upper end thereof, shaped applicator means positioned at said opening, said applicator means comprising a non-flexible, non-deformable, sintered, porous synthetic resin structure having a controlled porosity and having omni-directional interconnecting pores, spring means affixed to said opening, said spring means being adapted to normally urge said applicator means outward from said opening, and allow movement of said applicator means toward said opening when said applicator means is pressed against a surface, said applicator means being affixed to said spring means; an aperture through said applicator means adjacent to the central area thereof, said aperture being from about 0.005 to about 0.030 inches in diameter whereby said aperture retains the liquid in said container when the pressure inside and outside the container are substantially equal, but releases said liquid when there is a substantial pressure differential, thereby acting as a venting valve; said spring means providing an internal pressure in said container when said applicator means is pressed against a surface, whereby substantially equal pressures are maintained inside and outside of said container and substantially constant liquid flow can be maintained, on demand, through said applicator means.

2. The liquid applicator of claim 1 wherein said spring means comprises concentric cylindrical segments joined by an undulate annular planar member, said spring means being positioned in said container, said spring means forming a liquid tight seal between said applicator means and said container.

3. The liquid applicator of claim 2 wherein the outer cylindrical segment of said spring means fits in the opening of said container.

4. The liquid applicator of claim 3 wherein said applicator means fits on the inner of said concentric cylinder segments.

5. The liquid applicator of claim 2 wherein said applicator means fits on a sleeve means of the inner cylindrical, segment of said spring means.

6. The liquid applicator of claim 1 wherein the outer cylindrical segment of said spring means fits in the opening of said container.

7. The liquid applicator of claim 1 wherein said capillary valve has a counter-sink area on the outer surface of said applicator means.

* * * * *

UNITED STATES PATENT AND TRADEMARK OFFICE

CERTIFICATE OF CORRECTION

PATENT NO. : 5,073,057

DATED : 12/17/91

INVENTOR(S) : S. C. Lathrop, K. Woodruff, E. Morris

It is certified that error appears in the above-identified patent and that said Letters Patent is hereby corrected as shown below:

Title page, item [63], Related U.S. Application Data, delete "880,905" and insert -- 880,960 -- .

(2) Column 2, line 13, "97,383" should read -- 497,383 -- .

Column 2, line 30, "38,327" should read -- 368,327 -- .

Column 2, line 60, "user" should read -- use -- .

Signed and Sealed this

Twentieth Day of April, 1993

*Attest:*

MICHAEL K. KIRK

*Attesting Officer*

*Acting Commissioner of Patents and Trademarks*